US008809683B2

(12) United States Patent
Niwa et al.

(10) Patent No.: US 8,809,683 B2
(45) Date of Patent: Aug. 19, 2014

(54) LEAKY COAXIAL CABLE

(71) Applicant: Fujikura Ltd., Tokyo (JP)

(72) Inventors: Atsuhiko Niwa, Koto-ku (JP); Fumio Suzuski, Sakura (JP)

(73) Assignee: Fujikura Ltd., Tokyo (JP)

( * ) Notice: Subject to any disclaimer, the term of this patent is extended or adjusted under 35 U.S.C. 154(b) by 0 days.

(21) Appl. No.: 14/064,303

(22) Filed: Oct. 28, 2013

(65) Prior Publication Data

US 2014/0048304 A1 Feb. 20, 2014

Related U.S. Application Data

(63) Continuation of application No. PCT/JP2012/082889, filed on Dec. 19, 2012.

(30) Foreign Application Priority Data

Apr. 26, 2012 (JP) ..... 2012-100561

(51) Int. Cl.
*H01B 11/18* (2006.01)

(52) U.S. Cl.
USPC ..... 174/102 R; 174/108

(58) Field of Classification Search
CPC .. H01B 11/878; H01B 13/202; H01B 13/204; H01B 13/208; H01B 13/206; H01Q 13/203; H01Q 13/20; B61L 3/22
USPC ..... 174/102 R, 105 R, 105 B, 103, 108
See application file for complete search history.

(56) References Cited

U.S. PATENT DOCUMENTS 4,599,121 A * 7/1986 Edwards et al. ..... 156/48
4,987,394 A * 1/1991 Harman et al. ..... 333/237
5,936,203 A * 8/1999 Ryman ..... 174/109
6,246,005 B1 * 6/2001 Mahlandt et al. ..... 174/102 R
7,956,818 B1 * 6/2011 Hsu et al. ..... 343/895
2012/0268336 A1 * 10/2012 Kitano ..... 343/790

FOREIGN PATENT DOCUMENTS

CN 101699651 A 4/2010
JP 09-198941 A 7/1997
JP 2003-069338 A 3/2003
JP 2003-123555 A 4/2003
JP 2010-103685 A 5/2010
JP 2011-061677 A 3/2011

OTHER PUBLICATIONS

T. Kishimoto, et al., "LCX Tsuushin Sisutemu (LCX Communications System), 1st ed.", Korona Publishing Co., Ltd., Tokyo, Japan, Aug. 1982, pp. 1-6, English Abstract.

* cited by examiner

*Primary Examiner* — Timothy Thompson
*Assistant Examiner* — Amol Patel
(74) *Attorney, Agent, or Firm* — Sughrue Mion, PLLC

(57) ABSTRACT

A leaky coaxial cable includes an inner conductor member extending in axis direction, to propagate signal; an insulator member covering the inner conductor member; a first outer conductor member having conductor wires on circumference surface of the insulator member with shielding density so as to leak a part of the signal to outside thereof; and a plurality of second outer conductor members contacting the first outer conductor member and arranged with constant pitch in the axis direction, to shield the signal; wherein, in the axis direction, each electrical length of the second outer conductor members is the same as electrical length between adjacent second outer conductor members; and the pitch is in range of 1/(1+0.766ν) times to 3/(1+ν) times of propagation wavelength of the signal in the inner conductor member, where ν is wavelength shortening coefficient of the propagation wavelength to free-space wavelength of the signal.

8 Claims, 5 Drawing Sheets

LEAKY COAXIAL CABLE

CROSS REFERENCE TO RELATED APPLICATIONS

This application is a continuation application of PCT application No. PCT/JP2012/082889 filed on Dec. 19, 2012, and claims the benefit of priority from JP 2012-100561 filed on Apr. 26, 2012; the entire contents of which are incorporated by reference herein.

BACKGROUND OF THE INVENTION

1. Field of the Invention

The present invention relates to a leaky coaxial cable.

2. Description of the Related Art

A leaky coaxial cable (LCX) is such that a plurality of slots are provided as a radiating part on an outer conductor of an ordinary coaxial cable. An electromagnetic wave signal supplied to an inner conductor may be shielded by the outer conductor, but leaked outside through the slots serving as the radiating part. More specifically, through the slots, the electromagnetic wave signal in the cable may be radiated outwards, or the electromagnetic wave signal outside the cable may be taken into the cable. In other words, the LCX may be a cable type antenna and a specialized, long and thin transmitting and receiving antenna.

The LCX is widely used as a communication line for a moving vehicle, such as a railroad, a car and the like. In an application to a wireless communication of a train, the LCX which is laid along a railroad line can serve as a communication antenna with an antenna provided in a railroad vehicle. Also, in recent years, the LCX can be used as an antenna for a wireless LAN.

In the conventional LCX, a metal tape having slots formed by a punching process is used as the outer conductor (refer to T. Kishimoto and S. Sasaki, "LCX Communication System", The Institute of Electronics, Information and Communication Engineers, Aug. 20, 1982 (S57)). In this case, since one lengthwise metal tape is added in a longitudinal direction of the LCX, there is a problem of inferior flexibility. Also, because of inferior flexibility, a crack may be generated in the outer conductor from the slots when the LCX is bent.

In order to produce the LCX having superior flexibility, an idea of using the outer conductor of a braided wrap type or a serving (or spiral) wrap type, which is spirally wrapped around the insulator, is proposed (refer to Japanese Patent Laid-Open No. Hei 9(1997)-198941 and Japanese Patent Laid-Open No. 2003-123555). Gaps between adjacent outer conductors can be used as the radiating parts. In the proposed outer conductor, since the braided wrap or the serving wrap of wires, or the metal tape is used, flexibility can be improved.

However, since the spirally wrapped outer conductor is used, design freedom of the pitch of the radiating part may be degraded. It is actually difficult to make the angle of the braided wrap or the serving wrap to approximately 10 degrees or less, and thus there is a limit to increase the pitch of the radiating part . For example, in a case that an outer diameter of an insulator is about 5 mm, the limit of the pitch of the radiating part may be about 90 mm or less. Also, in the conventional LCX, since the pitch of the radiating part corresponds with a signal wavelength at a frequency where a radiation angle is vertical to the axis direction of the LCX, a large voltage standing wave ratio (VSWR) is generated in the LCX, and such LCX may be useless.

SUMMARY OF THE INVENTION

In the light of the aforementioned problem, an object of the present invention is to provide a LCX having superior flexibility and high degree of design freedom of a pitch of a radiating part.

An aspect of the present invention inheres in a leaky coaxial cable including an inner conductor member extending in an axis direction, configured to propagate a signal; an insulator member covering the inner conductor member; a first outer conductor member having conductor wires on a circumference surface of the insulator member with a shielding density so as to leak a part of the signal to an outside thereof; and a plurality of second outer conductor members contacting the first outer conductor member and being arranged with a constant pitch in the axis direction, configured to shield the signal; wherein, in the axis direction, each electrical length of the second outer conductor members is the same for an electrical length between adjacent second outer conductor members; and the pitch is in a range of $\{1/(1+0.766\nu)\}$ times to $\{3/(1+\nu)\}$ times of a propagation wavelength of the signal in the inner conductor member, where $\nu$ is a wavelength shortening coefficient of the propagation wavelength to a free-space wavelength of the signal.

DETAILED DESCRIPTION OF THE EMBODIMENT OF THE INVENTION

Figure 1:
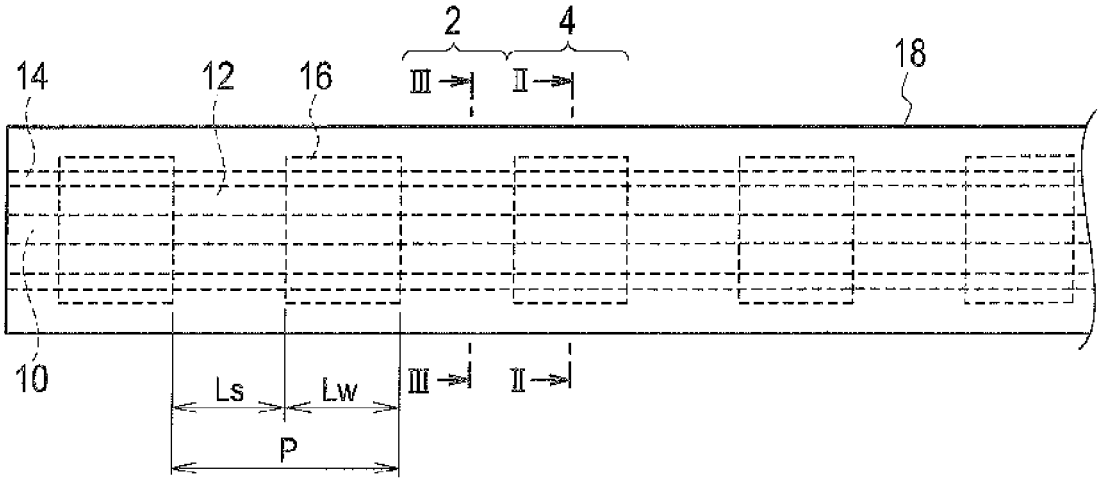
FIG. 1 is a schematic view showing an example of a LCX according to an embodiment of the present invention.

Various embodiments of the present invention will be described with reference to the accompanying drawings. In the following description of the drawings, same or similar parts are given same or similar reference numerals. However, it is noted that the drawings are schematic and that the relationship between thickness and planar dimensions, the proportion of thicknesses of layers, and the like are different from real ones. Accordingly, specific thicknesses and dimensions should be determined with reference to the following description. It is certain that some portions have different dimensional relations and proportions between the drawings.

Also, the following embodiments show devices and methods to embody the technical idea of the invention by way of example. The technical ideas of the invention do not specify the materials, shapes, structures, arrangements, and the like of the constituent components to those described below. The technical idea of the invention can be variously changed within the scope of claims.

Figure 2:
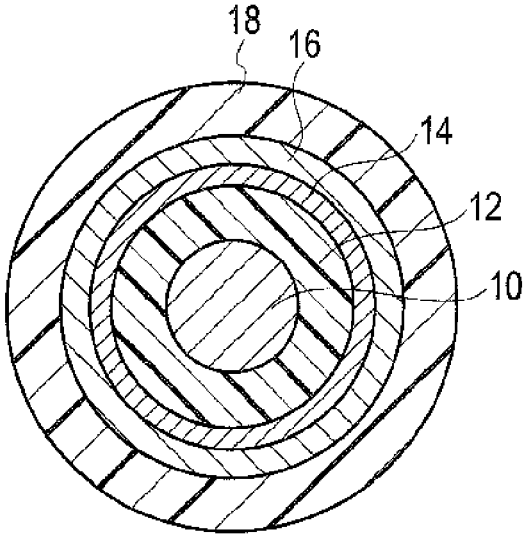
FIG. 2 is a cross sectional view taken along line II-II of the LCX shown in FIG. 1.
Figure 3:
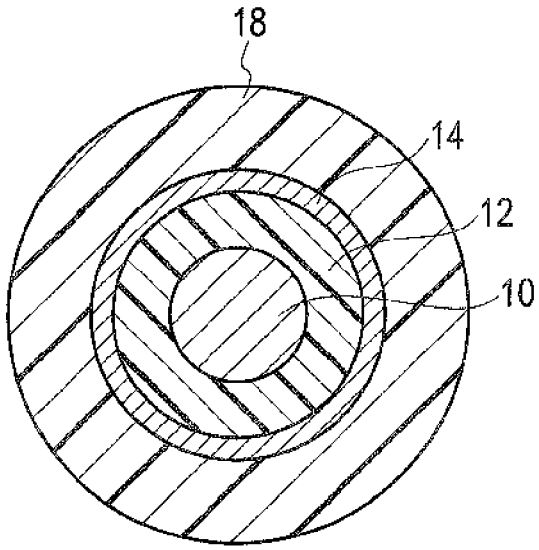
FIG. 3 is a cross sectional view taken along line III-III of the LCX shown in FIG. 1.

A LCX according to an embodiment of the present invention includes an inner conductor member 10, an insulator member 12, a first outer conductor member 14, a plurality of second outer conductor members 16, and a sheath 18, as shown in FIGS. 1 to 3. The inner conductor member 10 extends in the axis direction of the LCX. The insulator member 12 is provided so as to cover the inner conductor member 10. The first outer conductor member 14 is provided so as to cover the inner conductor member 10 sandwiching the insulator member 12 therebetween. Each of the second outer conductor members 16 contacts the first outer conductor member 14 and arranged with a constant pitch P. The sheath 18 is provided so as to cover outer circumferences of the first and second outer conductor members 14, 16.

A shielding part 4 is a region of a length Lw, where each of the second outer conductor members 16 is arranged, and a radiating part 2 is a region of a length Ls between the adjacent second outer conductor members 16. More specifically, as shown in FIG. 2, the first and second outer conductor members 14 and 16 are double arranged in the shielding part 4. As shown in FIG. 3, only the first outer conductor member 14 is arranged in the radiating part 2. The length Ls of the radiating part 2 and the length Lw of the shielding part 4 are substantially equal to each other.

For example, for the inner conductor member 10, a metal, such as copper and the like maybe used. For the insulator member 12, a resin, such as foamed polyethylene and the like may be used. For the first conductor member 14, a braided wrap or a serving (spiral) wrap, which has electrical conductivity, using conductor wires, such as metal and the like, may be used. For the second conductor member 14, a conductor film, such as a metal film, metal foil and the like, may be used. For the sheath 18, a resin, such as a flame-retardant polyethylene and the like, may be used.

A high frequency signal supplied from an external signal source or the like is propagated through the inner conductor member 10. In the shielding part 4, since the second outer conductor members 16 shield the high frequency signal, the high frequency signal may not be radiated to outside of the LCX. In the radiating part 2, since the first outer conductor member 14 is the braided wrap, a part of the high frequency signal may be leaked to the outside of the LCX. More specifically, an electromagnetic wave may be radiated from the radiating parts 2, arranged at a pitch P, to the outside of the LCX. The pitch P is determined depending on the frequency of the supplied high frequency signal.

A shield density of the metal wires, used for the braided wrap or the serving wrap, of the first outer conductor member 14 with respect to the circumference surface of the insulator member 12 may be in a range of 70% or less. When the shield density is more than 70%, the electromagnetic wave may not be sufficiently radiated from the radiating part 2. In addition, the shield density is the ratio of the entire area of the conductor wires, which is arranged on the circumference surface of the insulator member 12, to the surface area of the insulator member 12.

In such way, in the LCX according to the embodiment, the first outer conductor member 14 is provided with the low shield density, so as to leak the high frequency signal, and the second outer conductor members 16 are provided with the conductor film in contact with the first outer conductor member 14, so as not to leak the high frequency signal. For this reason, the first and second outer conductor members 14, 16 have the same electric potential, and the electromagnetic wave may not be radiated in the shielding part 4, and the electromagnetic wave may be radiated from the radiating part 2 to the outside of the LCX. In the embodiment, since the braided wrap is used for the first outer conductor member 14 and the second outer conductor members 16 are repeatedly arranged with predetermined spacing, it is possible to provide the LCX having superior flexibility. Also, since the pitch of the radiating part 2 can be determined by the arrangement sequence and the width of the second outer conductor member 16, the degree of design freedom may become higher. In addition, even if the serving wrap is used for the first outer conductor member 14, the similar effectiveness may be obtained.

Generally, a radiation angle θn of the electromagnetic wave from the LCX is represented by the following equation, when the radiation angle perpendicular to the axis direction of the LCX is defined as 0 and a radiation direction inclined to a termination side is defined as positive (refer to T. Kishimoto and S. Sasaki, "LCX Communication System", The Institute of Electronics, Information and Communication Engineers, Aug. 20, 1982 (S57)).

$$\theta n=\sin^{-1}(n\lambda/P+1/\nu) \quad (1)$$

Here, n is a mode of a radiation wave having a negative integer, λ is a wavelength in the free space, and ν is a wavelength shortening coefficient of the LCX. The wavelength shortening coefficient ν can be represented by an effective relative dielectric constant ∈s which is determined from a volume ratio of an insulator and a hollow portion between the inner conductor and the outer conductor, as follows.

$$\nu=1/(\in s)^{1/2} \quad (2)$$

Usually, only the $-1^{st}$ order mode, that is n=−1, is used in many cases. In the frequency where the $-2^{nd}$ order mode and the higher order modes occur, since the electromagnetic waves radiated with a plurality of angles, which include the $-1^{st}$ order mode, interfere with each other and the standing wave is consequently generated, it is difficult to achieve the radiation of the electromagnetic wave having uniform strength. Conventionally, by using the LCX of a complicated zigzag slot array, broader bandwidth is tried to attain by preventing generation of the high order modes.

On the other hand, in the embodiment, the electrical lengths of the radiating part 2 and the shielding part 4 are same with each other in the axis direction, so as not to generate the $-2^{nd}$ order mode. Here, the "electrical length" is defined as a product of the physical length and the wavelength shortening coefficient ν. The effective relative dielectric constants of the radiating part 2 and the shielding part 4 are not equal, but substantially equal to each other. Consequently, by making the physical lengths of the radiating part 2 and the shielding part 4 approximately the same, the electrical lengths of the radiating part 2 and the shielding part 4 correspond with each other. In this way, in the LCX according to the embodiment, it is possible to prevent generation of the $-2^{nd}$ order mode radiation by using a simple structure, and to achieve the broader bandwidth.

Specifically, the frequency band in which only the $-1^{st}$ order mode is radiated is represented by the following equation.

$$(1+1/\nu)/2<\lambda/P<(1+1/\nu) \quad (3)$$

In the LCX according to the embodiment, since the $-2^{nd}$ order mode may not be radiated, it is possible to use even the frequency band in which the $-1^{st}$ order mode and the $-2^{nd}$ order mode may be radiated when using the conventional LCX. Hence, the frequency band may be expanded as shown by the following equation.

$$(1+1/\nu)/3<\lambda/P<(1+1/\nu) \quad (4)$$

More specifically, it is possible to use the range of the radiation angle between −90° and +30° where the $-3^{rd}$ order mode may be radiated when using the conventional LCX.

From the equation (4), the pitch P may be provided so as to satisfy the condition represented by the following equation.

$$\lambda g/(1+\nu)<P<3\lambda g/(1+\nu) \quad (5)$$

Here, λg is the propagation wavelength in the LCX, and λg=νλ. In addition, empirically, for the radiation angle of the $-1^{st}$ order mode, an actual critical angle may be −50°. Thus, a range of the pitch P shown in the following equation is desirable.

$$\lambda g/(1+0.776\nu)<P<3\lambda g/(1+\nu) \quad (6)$$

Furthermore, at a frequency where the radiation angle of the $-1^{st}$ order mode may be 0°, the slot pitch coincides with the wavelength. For this reason, the VSWR of the LCX may increase in the common LCX, and thus the common LCX may be useless in such frequency. On the contrary, in the LCX according to the embodiment, the lengths Ls and Lw, which are the physical lengths of the radiating part 2 and the shielding part 4, respectively, are made approximately the same, as shown in FIG. 1. Impedance Z1 of the radiating part 2 is greater than impedance Z2 of the shielding part 4. Therefore, the propagation signal is slightly reflected in a boundary plane between the radiating part 2 and the shielding part 4. For example, reflection voltage V1 of the propagation signal to the shielding part 4 from the radiating part 2 is (Z2−Z1)/(Z2+Z1), and reflection voltage V2 of the propagation signal to the radiating part 2 from the shielding part 4 is (Z1−Z2)/(Z2+Z1). Phases of the reflection voltage V1 and the reflection voltage V2 become opposite to each other. Therefore, although reflection wave is strictly not zero if influences of attenuation and multiple reflection in the LCX are considered, reflection wave may be assumed approximately 0. As a result, it is possible to suppress the VSWR, and to use even in the frequency where the radiation angle for the $-1^{st}$ order mode is 0°. Specifically, in the embodiment, it is possible to use a range of 0.9 times to 1.1 times of the wavelength of the propagation wave in the LCX, for the pitch.

Figure 4:
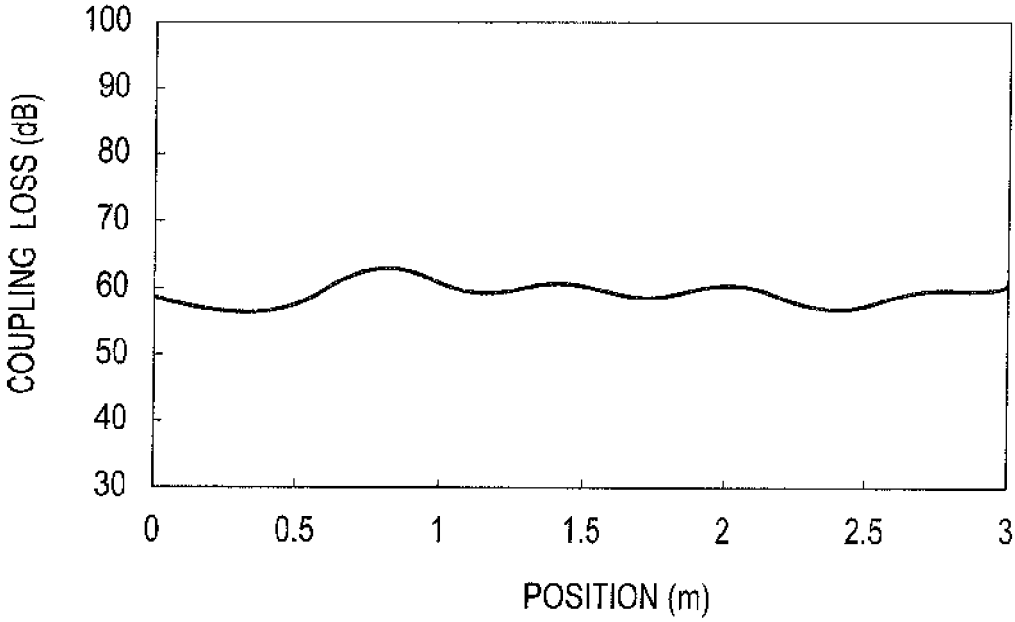
FIG. 4 is a view showing an example of a coupling loss measurement result of the LCX according to the embodiment of the present invention.

FIG. 4 shows a measurement result of coupling loss using a preproduction sample of the LCX according to the embodiment. Working frequency is 520 MHz. The inner conductor member 10 of the preproduction LCX is an annealed conductor wire having an outer diameter of about 1.5 mm. The insulator member 12 is a foamed polyethylene having an outer diameter of about 7.3 mm. The first outer conductor member 14 is a braided wrap, in which tin-plated annealed copper wires each having an outer diameter of about 0.14 mm are used as conductor wires, a number of wires in each carrier is 4, a number of carriers is 16, a pitch is 16 mm, and a shielding density is about 56%. The second outer conductor member 16 is a copper foil having a width in the axis direction of the LCX of about 225 mm and a pitch P of about 450 mm. The sheath 18 is made of polyvinyl chloride (PVC) having thickness of about 1 mm and an outer diameter of about 10 mm.

The measurement method of the coupling loss is pursuant to the international standard IEC 61196-4. The separation distance between the preproduction LCX and the standard dipole antenna is 1.5 m. The position of an end of the LCX to which the high frequency signal is supplied is defined as "0". The preproduction LCX is horizontally laid on a ground, and the coupling loss of a horizontally polarized wave is measured at 520 MHz. As shown in FIG. 4, it has been confirmed that the coupling loss of about 60 dB may be ensured even at the position separated by 3 m from the feeding end.

Figure 5:
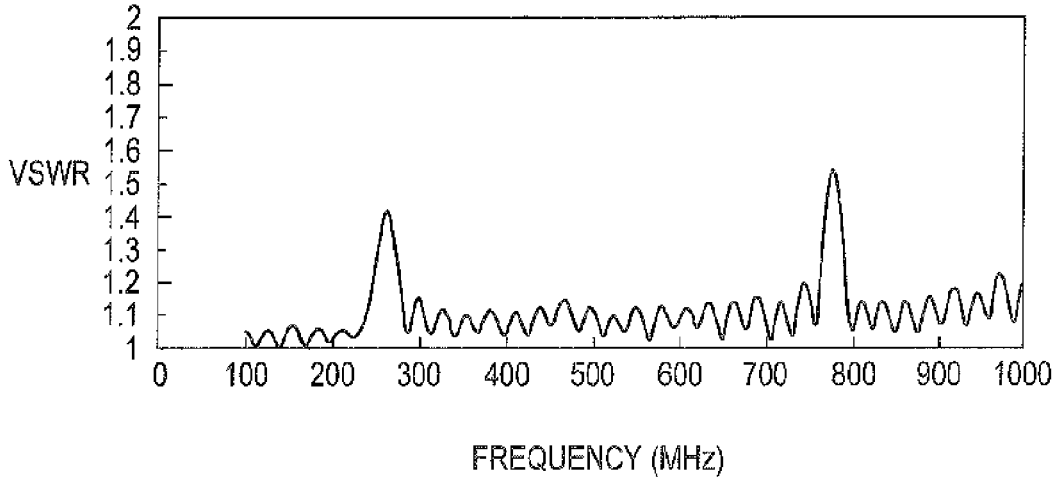
FIG. 5 is a view showing an example of a standing wave ratio measurement result of the LCX according to the embodiment of the present invention.

FIG. 5 shows the measurement result of VSWR with respect to the frequency using the preproduction LCX. As shown in FIG. 5, it has been confirmed that the value of VSWR is extremely small as about 1.1 in the vicinity of 520 MHz of the working frequency where the radiation angle of the $-1^{st}$ order mode is 0°.

Figure 6:
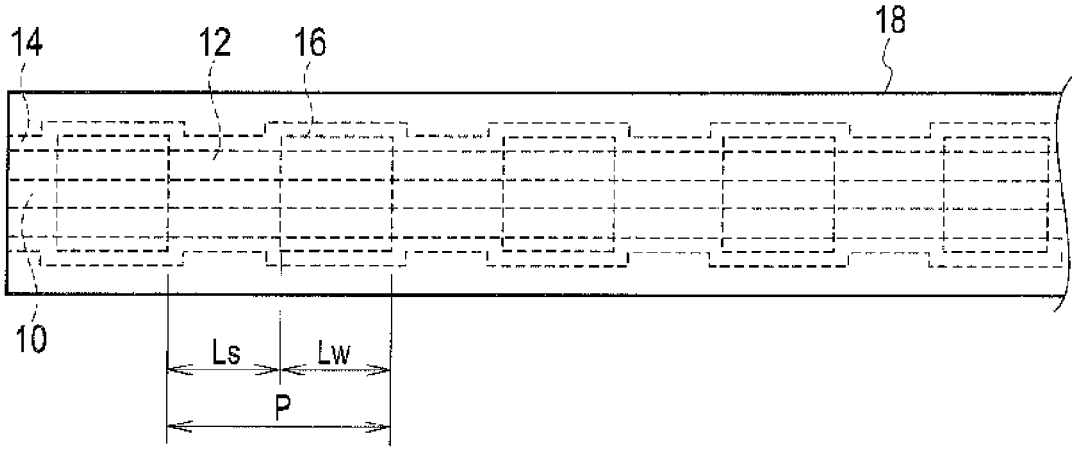
FIG. 6 is a schematic view showing another example of the LCX according to the embodiment of the present invention.

In addition, as shown in FIG. 1, the second outer conductor members 16 are arranged on the first outer conductor member 14. However, as shown in FIG. 6, the second outer conductor members 16 may be arranged in contact with the insulator member 12, and the first outer conductor member 14 may be arranged so as to cover the second outer conductor members 16 and the insulator member 12.

Figure 7:
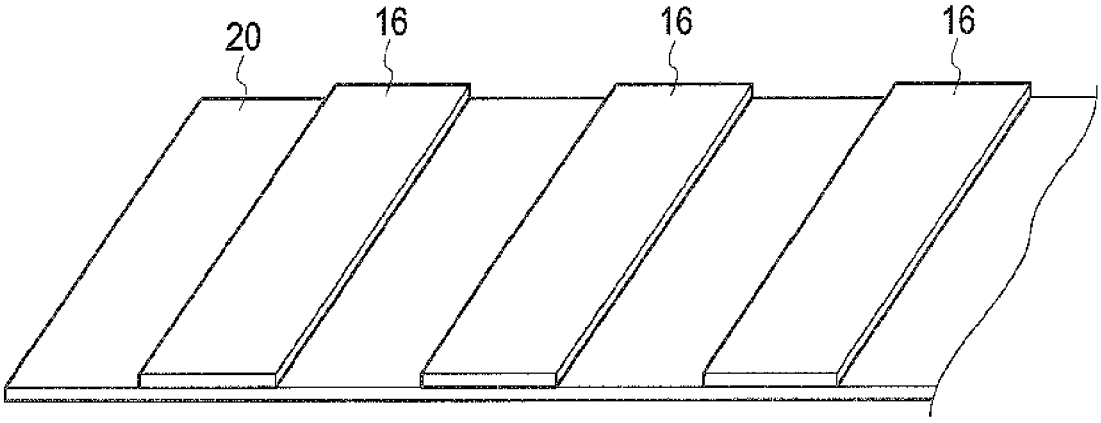
FIG. 7 is a perspective view showing an example of a tape used to form the second outer conductor of the LCX according to the embodiment of the present invention.

As mentioned above, the second outer conductor members 16 are repeatedly arranged with the pitch P. For example, as shown in FIG. 7, a tape in which a plurality of second outer conductor members 16 are repeatedly arranged on an insulating film 20 made of plastic and the like is prepared. By using the tape lengthwise such that the second outer conductor members 16 contact the first outer conductor member 14, it is possible to accurately control the length Ls of the radiating part 2 and the length Lw of the shielding part 4, shown in FIGS. 1 and 6, and thereby to easily achieve the structure of the LCX according to the embodiment.

Figure 8:
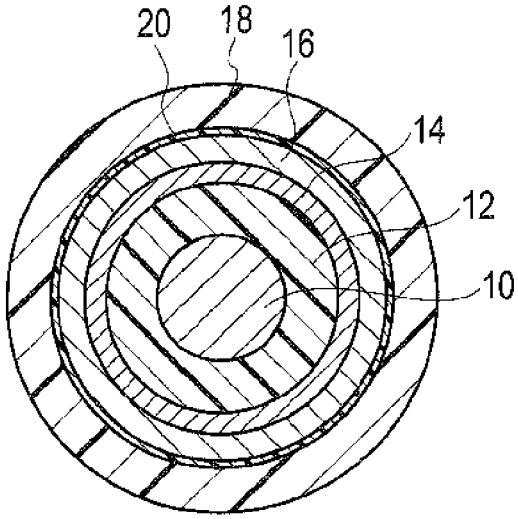
FIG. 8 is a cross sectional schematic view showing an example of the LCX formed by using the tape shown in FIG. 7.
Figure 9:
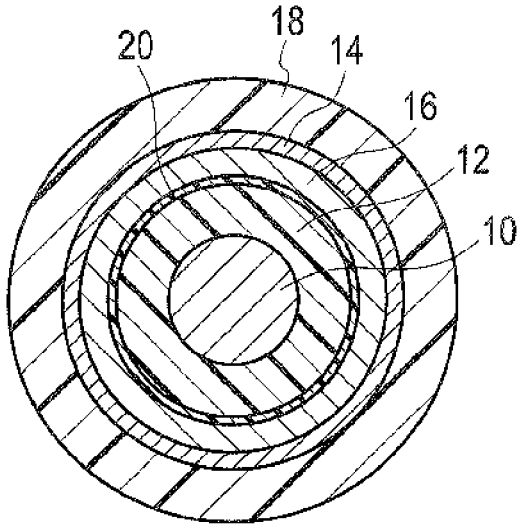
FIG. 9 is a cross sectional schematic view showing another example of the LCX formed by using the tape shown in FIG. 7.

Furthermore, as the tape shown in FIG. 7, an adhesive layer may be formed on a surface of the insulating film 20 opposite to a surface on which the second outer conductor members 16 are arranged. For example, when the second outer conductor members 16 are disposed between the sheath 18 and the first outer conductor member 14, as shown in FIG. 8, the insulating film 20 is adhered to the sheath 18 by using the adhesive layer. Also, when the second outer conductor members 16 are disposed between the insulator member 12 and the first outer conductor member 14, as shown in FIG. 9, the insulating film 20 is adhered to the insulator member 12 by using the adhesive layer. Since the second outer conductor members 16 are strongly adhered to the sheath 18 or insulator member 12 by the adhesive layer, variations of the lengths Ls and Lw of the radiating part 2 and the shielding part 4 or variation of the pitch P can be prevented from occurring. As a result, it is possible to suppress unstable radiation of the electromagnetic wave and generation of a space where the electromagnetic wave is weak, such as a dip, a null point, or the like. Consequently, it is possible to provide desirable properties of the LCX stably over a long period of time.

In addition, the braided wrap or the serving wrap is used for the first outer conductor member 14. However, for example, a plurality of lengthwise conductor wires, a mesh of conductor wires, or a plurality of lengthwise narrow conductor tapes may be used. Also, the conductor film, such as a metal film, a metal foil and the like, is used as the second outer conductor member 16. However, for example, a solder plating film, a conductive resin film, a conductive paint film, and the like may be used.

(Other Embodiments)

The present invention has been described as mentioned above. However the descriptions and drawings that constitute a portion of this disclosure should not be perceived as limiting this invention. Various alternative embodiments and operational techniques will become clear to persons skilled in the art from this disclosure. Accordingly, the technical scope of the present invention is determined by only the features of the invention according to proper claims.

What is claimed is:

1. A leaky coaxial cable comprising:

an inner conductor member extending in an axis direction, configured to propagate a signal;

an insulator member covering the inner conductor member;

a first outer conductor member having conductor wires on a circumference surface of the insulator member with a shielding density so as to leak a part of the signal to an outside thereof; and a plurality of second outer conductor members contacting the first outer conductor member and being arranged with a constant pitch in the axis direction, configured to shield the signal;

wherein, in the axis direction, each electrical length of the second outer conductor members is the same as an electrical length between adjacent second outer conductor members; and the pitch is in a range of $\{1/(1+0.766v)\}$ times to $\{3/(1+v)\}$ times of a propagation wavelength of the signal in the inner conductor member, where V is a wavelength shortening coefficient of the propagation wavelength to a free-space wavelength of the signal.

2. The leaky coaxial cable of claim 1, wherein the pitch is in a range of 0.9 times to 1.1 times of the propagation wavelength.

3. The leaky coaxial cable of claim 1, wherein the shielding density of the conductor wires is in a range of 70% or less.

4. The leaky coaxial cable of claim 1, wherein the first outer conductor member is a braided wrap or a serving wrap using the conductor wires.

5. The leaky coaxial cable of claim 1, wherein each of the second outer conductor members is a metal film.

6. The leaky coaxial cable of claim 1, wherein the second outer conductor members are periodically arranged with the pitch on an insulating film.

7. The leaky coaxial cable of claim 6, further comprising a sheath covering the first outer conductor member and the second outer conductor members;

Wherein the second outer conductor members are disposed between the sheath and the first outer conductor member, and the insulating film is adhered to the sheath.

8. The leaky coaxial cable of claim 6, wherein the second outer conductor members are disposed between the insulator member and the first outer conductor member, and the insulating film is adhered to the insulator member.

* * * * *